US008506229B2

(12) United States Patent
Orgeron

(10) Patent No.: US 8,506,229 B2
(45) **Date of Patent: *Aug. 13, 2013**

(54) PIPE HANDLING APPARATUS AND METHOD

(75) Inventor: Keith J. Orgeron, Houston, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/076,727

(22) Filed: Mar. 31, 2011

(65) Prior Publication Data

US 2011/0200412 A1 Aug. 18, 2011

Related U.S. Application Data

(63) Continuation of application No. 11/923,451, filed on Oct. 24, 2007, now Pat. No. 7,918,636.

(51) Int. Cl.
*E21B 19/15* (2006.01)

(52) U.S. Cl.
USPC ..... 414/22.55

(58) Field of Classification Search
USPC ..... 166/77.52, 77.53; 175/85; 294/81.61; 414/22.55, 22.62, 23, 546, 680, 729, 738, 414/740, 742, 746.8, 783, 701, 736, 776; 52/119–120; 74/103, 110, 490.01, 490.05, 74/63, 66, 68; 901/15–16, 21–22, 48
See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 364,077 | A | 5/1887 | Addis |
| 1,264,867 | A | 4/1918 | Schuh |
| 1,312,009 | A | 8/1919 | Thrift |
| 1,318,789 | A | 10/1919 | Moschel |
| 1,369,165 | A | 2/1921 | Cochran et al. |
| 1,396,317 | A | 11/1921 | Boyter |
| 1,417,490 | A | 5/1922 | Brandon |
| 1,972,635 | A | 9/1934 | Whinnen |
| 1,981,304 | A | 11/1934 | Brandt |
| 2,124,154 | A | 7/1937 | Sovincz |
| 2,147,002 | A | 2/1939 | Volpin |
| 2,327,461 | A | 8/1943 | Rowe |

(Continued)

FOREIGN PATENT DOCUMENTS

| | | | |
|---|---|---|---|
| GB | 727780 | A | 4/1955 |
| GB | 2264736 | A | 9/1993 |

*Primary Examiner* — Gregory Adams
(74) *Attorney, Agent, or Firm* — John G. Fischer, Esq.; Paul D. Lein, Esq.; Scheef & Stone, L.L.P.

(57) ABSTRACT

A pipe handling apparatus has a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having a one end pivotally connected to the boom and an opposite end pivotally connected to the arm between the ends of the arm. The riser assembly has a first portion extending outwardly at an obtuse angle with respect to the second portion.

15 Claims, 4 Drawing Sheets

(56) References Cited

U.S. PATENT DOCUMENTS

| | | | | | |
|---|---|---|---|---|---|
| 2,369,534 | A | | 2/1945 | Cohen | |
| 2,382,767 | A | | 8/1945 | Zeilman | |
| 2,476,210 | A | | 7/1949 | Moore | |
| 2,509,853 | A | | 5/1950 | Wilson | |
| 2,595,307 | A | | 5/1952 | Selberg | |
| 2,715,014 | A | | 8/1955 | Garnett et al. | |
| 2,814,396 | A | | 11/1957 | Neal, Sr. | |
| 2,840,244 | A | | 6/1958 | Thomas, Jr. | |
| 3,016,992 | A | | 1/1962 | Wilson | |
| 3,076,560 | A | | 2/1963 | Bushong et al. | |
| 3,136,394 | A | | 6/1964 | Woolslayer et al. | |
| 3,177,944 | A | | 4/1965 | Knights | |
| 3,180,496 | A | | 4/1965 | Smith | |
| 3,194,313 | A | | 7/1965 | Fanshawe | |
| 3,262,593 | A | * | 7/1966 | Hainer | 414/619 |
| 3,280,920 | A | | 10/1966 | Scott | |
| 3,477,522 | A | | 11/1969 | Templeton | |
| 3,559,821 | A | | 2/1971 | James | |
| 3,633,771 | A | | 1/1972 | Woolslayer et al. | |
| 3,682,259 | A | | 8/1972 | Cintract et al. | |
| 3,702,640 | A | | 11/1972 | Cintract et al. | |
| 3,703,968 | A | * | 11/1972 | Uhrich et al. | 414/680 |
| 3,706,347 | A | | 12/1972 | Brown | |
| 3,774,781 | A | | 11/1973 | Merkley | |
| 3,792,783 | A | | 2/1974 | Brown | |
| 3,797,672 | A | | 3/1974 | Vermette | |
| 3,804,264 | A | | 4/1974 | Hedeen et al. | |
| 3,806,021 | A | | 4/1974 | Moroz et al. | |
| 3,942,593 | A | | 3/1976 | Reeve, Jr. et al. | |
| 3,986,619 | A | | 10/1976 | Woolslayer et al. | |
| 3,991,887 | A | | 11/1976 | Trout | |
| 3,995,746 | A | * | 12/1976 | Usagida | 414/738 |
| 4,044,952 | A | | 8/1977 | Williams et al. | |
| 4,135,340 | A | | 1/1979 | Cox et al. | |
| 4,142,551 | A | | 3/1979 | Wilms | |
| 4,172,684 | A | | 10/1979 | Jenkins | |
| 4,201,022 | A | | 5/1980 | Jennings | |
| 4,269,554 | A | | 5/1981 | Jackson | |
| 4,290,495 | A | | 9/1981 | Elliston | |
| 4,386,883 | A | | 6/1983 | Hogan et al. | |
| 4,403,898 | A | | 9/1983 | Thompson | |
| 4,407,629 | A | | 10/1983 | Willis | |
| 4,426,182 | A | | 1/1984 | Frias et al. | |
| 4,440,536 | A | | 4/1984 | Scaggs | |
| 4,529,094 | A | | 7/1985 | Wadsworth | |
| 4,547,110 | A | | 10/1985 | Davidson et al. | |
| 4,595,066 | A | | 6/1986 | Nelmark et al. | |
| 4,598,509 | A | | 7/1986 | Woolslayer et al. | |
| 4,604,724 | A | * | 8/1986 | Shaginian et al. | 700/213 |
| 4,688,983 | A | | 8/1987 | Lindbom | |
| 4,708,581 | A | | 11/1987 | Adair | |
| 4,759,414 | A | * | 7/1988 | Willis | 175/170 |
| 4,765,401 | A | | 8/1988 | Boyadjieff | |
| 4,767,100 | A | | 8/1988 | Philpot | |
| 4,822,230 | A | | 4/1989 | Slettedal | |
| 4,834,604 | A | | 5/1989 | Brittain et al. | |
| 4,837,992 | A | | 6/1989 | Hashimoto | |
| 4,982,853 | A | | 1/1991 | Kishi | |
| 5,121,793 | A | | 6/1992 | Busch et al. | |
| 5,458,454 | A | | 10/1995 | Sorokan | |
| 5,609,260 | A | | 3/1997 | Liao | |
| 5,806,589 | A | | 9/1998 | Lang | |
| 5,848,647 | A | | 12/1998 | Webre et al. | |
| 5,931,238 | A | | 8/1999 | Gilmore et al. | |
| 5,988,299 | A | | 11/1999 | Hansen et al. | |
| 5,993,140 | A | | 11/1999 | Crippa | |
| 6,003,598 | A | | 12/1999 | Andreychuk | |
| 6,079,490 | A | | 6/2000 | Newman | |
| 6,079,925 | A | | 6/2000 | Morgan et al. | |
| 6,220,807 | B1 | * | 4/2001 | Sorokan | 414/22.62 |
| 6,298,928 | B1 | | 10/2001 | Penchansky | |
| 6,343,892 | B1 | | 2/2002 | Kristiansen | |
| 6,431,286 | B1 | | 8/2002 | Andreychuk | |
| 6,524,049 | B1 | | 2/2003 | Minnes | |
| 6,533,045 | B1 | | 3/2003 | Cooper | |
| 6,550,128 | B1 | | 4/2003 | Lorenz | |
| 6,557,641 | B2 | | 5/2003 | Sipos et al. | |
| 6,581,698 | B1 | | 6/2003 | Dirks | |
| 6,609,573 | B1 | | 8/2003 | Day | |
| 6,705,414 | B2 | | 3/2004 | Simpson et al. | |
| 6,763,898 | B1 | | 7/2004 | Roodenburg et al. | |
| 6,779,614 | B2 | | 8/2004 | Oser | |
| 6,814,149 | B2 | | 11/2004 | Liess et al. | |
| 6,854,520 | B1 | | 2/2005 | Robichaux | |
| 7,036,202 | B2 | | 5/2006 | Lorenz | |
| 7,044,315 | B2 | | 5/2006 | Willim | |
| 7,077,209 | B2 | | 7/2006 | McCulloch et al. | |
| 7,090,035 | B2 | | 8/2006 | Lesko | |
| 7,289,871 | B2 | | 10/2007 | Williams | |
| 7,503,394 | B2 | | 3/2009 | Bouligny | |
| 7,726,929 | B1 | | 6/2010 | Orgeron | |
| 7,918,636 | B1 | * | 4/2011 | Orgeron | 414/22.55 |
| 7,946,795 | B2 | * | 5/2011 | Orgeron | 414/22.55 |
| 8,011,426 | B1 | | 9/2011 | Orgeron | |
| 8,128,332 | B2 | | 3/2012 | Orgeron | |
| 8,172,497 | B2 | | 5/2012 | Orgeron et al. | |
| 8,192,128 | B2 | | 6/2012 | Orgeron | |
| 8,192,129 | B1 | * | 6/2012 | Orgeron | 414/22.55 |
| 2002/0070187 | A1 | | 6/2002 | Willim | |
| 2002/0079105 | A1 | | 6/2002 | Bergeron | |
| 2003/0170095 | A1 | | 9/2003 | Slettedal | |
| 2004/0040926 | A1 | | 3/2004 | Irsch et al. | |
| 2005/0269133 | A1 | | 12/2005 | Little | |
| 2006/0027793 | A1 | | 2/2006 | Kysely | |
| 2006/0045654 | A1 | | 3/2006 | Guidroz | |
| 2006/0151215 | A1 | | 7/2006 | Skogerbo | |
| 2006/0278400 | A1 | | 12/2006 | Bouligny | |
| 2007/0074460 | A1 | | 4/2007 | Belik | |
| 2008/0202812 | A1 | | 8/2008 | Childers et al. | |
| 2008/0253866 | A1 | | 10/2008 | Lops et al. | |
| 2009/0071720 | A1 | | 3/2009 | Cowan | |
| 2010/0032213 | A1 | | 2/2010 | Orgeron | |
| 2010/0230166 | A1 | | 9/2010 | Sigmar et al. | |
| 2012/0170998 | A1 | | 7/2012 | Orgeron | |

* cited by examiner

PIPE HANDLING APPARATUS AND METHOD

CROSS-REFERENCE TO RELATED APPLICATIONS

This application is a continuation of U.S. Pat. No. 7,918,636, formerly patent application Ser. No. 11/923,451, filed on Oct. 27, 2007, and issued on Apr. 5, 2011.

BACKGROUND OF THE INVENTION

1. Field of the Invention

The present invention relates to a tubular or pipe handling apparatus. More particularly, the present invention relates to a pipe handling apparatus for moving a pipe from a horizontal orientation to a vertical orientation. Additionally, the present invention relates to pipe handling apparatus for installing pipes upon a drilling rig. The present invention also relates to pipe handling apparatus that moves the pipe with a single degree of freedom.

2. Description of Related Art Including Information Disclosed Under 37 CFR 1.97 and 37 CFR 1.98

Drill rigs have utilized several methods for transferring tubular members from a pipe rack adjacent to the drill floor to a mousehole in the drill floor or the well bore for connection to a previously transferred tubular or tubular string. The term "tubular" or "pipe" as used herein includes all forms of drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent the rotary table which supports the pipe temporarily. When it is necessary to add the pipe to the drill string, slips are secured about the drill string on the rotary table thereby supporting the same in the well bore. The pipe is disconnected from the traveling equipment and the elevators, or the kelly, are connected to the pipe in the mousehole. Next, the traveling block is raised thereby positioning the pipe over the drill string and tongs are used to secure the pipe to the upper end of the drill string. The drill pipe elevators suspend the drill pipe from a collar which is formed around one end of the pipe and do not clamp the pipe thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Since the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It would be desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically oriented pipe can be installed into the well bore. Typically, these devices have utilized several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary so as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, various patents have issued relating to such pipe handling devices. For example, U.S. Pat. No. 3,177,944, issued on Apr. 13, 1965 to R. N. Knights, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972 to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer et al., shows a pipe handling apparatus for an oil well drilling derrick. In this apparatus the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, shows a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs is provided for making up and breaking out threaded connections of tubulars.

U.S. Pat. No. 4,407,629, issued on Oct. 4, 1983 to C. A. Willis, teaches a lifting apparatus for down-hole tubulars. This lifting apparatus includes two rotatably mounted clamps which are rotatable between a side loading-position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a down-hole tubular positioned in the clamp. In this position, the clamped tubular is aligned with a safety plate mounted on the boom to prevent a clamped tubular from slipping from the clamps.

U.S. Pat. No. 4,492,501, issued on Jan. 8, 1985 to K. M. Haney, provides a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230, issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581, issued on Nov. 24, 1987 H. L. Adair, provides a method for positioning a transfer arm for the movement of drill pipe. A drilling mast and a transfer arm are mounted at a first axis adjacent the mast to move between a lowered position near ground level and an upper position aligned with the mast. A reaction point anchor is fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

U.S. Pat. No. 4,759,414, issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, describes a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, shows another system and method for transferring pipe. A pipe shuttle is used for moving a pipe joint into a first position and then lifting upwardly toward an upper second position.

It is an object of the present invention to provide a pipe handling apparatus and method which minimizes the amount of calibration required in order to move the pipe from a horizontal orientation to a vertical orientation.

It is another object of the present invention to provide a pipe handling apparatus which operates with a single degree of freedom so as to move the pipe without adjustments between the components.

It is another object of the present invention to provide a pipe handling apparatus and method that can be transported on a skid or on a truck.

It is another object of the present invention to provide a pipe handling apparatus and method which allows for the self-centering of the pipe.

It is another object of the present invention to provide a pipe handling apparatus and method which can be utilized independent of the existing rig.

It is still a further object of the present invention to provide a pipe handling apparatus and method which avoids the use of multiple hydraulic cylinders and actuators.

It is still another object of the present invention to provide a pipe handling apparatus and method which minimizes the amount of instrumentation and controls utilized for carrying out the pipe handling activities.

It is still another object of the present invention to provide a pipe handling apparatus and method which allows for the pipe to be loaded beneath the lifting boom.

It is still a further object of the present invention to provide a pipe handling apparatus and method which is of minimal cost and easy to use.

It is still a further object of the present invention to provide a pipe handling apparatus and method which allows relatively unskilled workers to carry out the pipe handling activities.

These and other objects and advantages of the present invention will become apparent from a reading of the attached specification and appended claims.

BRIEF SUMMARY OF THE INVENTION

The present invention is a pipe handling apparatus that comprises a boom that is pivotally movable between a first position and a second position, a riser assembly pivotally connected to the boom, an arm pivotally connected at one end to the riser assembly and extending outwardly therefrom, a gripper affixed to an opposite end of the arm suitable for gripping a diameter of the pipe, a link pivotally connected to the riser assembly and pivotable at an end so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion. The arm is pivotally connected at one end to the first portion of the riser assembly. The link is pivotally connected to the end of the second portion of the riser assembly. Each of the brace, the link, the arm and the riser assembly are non-extensible items. Since the components are generally arranged in a common plane, there is only one degree of freedom between the components. As such, pipe can be moved from the loading position to the installation position without any other adjustment between the components.

In the present invention, the first position of the boom is generally horizontal. The gripper will have a vertical orientation when the boom is in the second position.

A skid extends in a horizontal orientation and is positioned below the boom. The boom is pivotally mounted upon the skid. A vehicle having a bed can be utilized so as to receive the skid thereon. The end of the link opposite the second portion of the riser is pivotally mounted upon the skid in a position offset from and below the pivotal mounting of the boom upon the skid.

In the present invention, a pipe will extend in a horizontal orientation upon this skid. The gripper faces the pipe when the boom is in the first position. This gripper is positioned below the boom when the boom is in the first position.

The boom has a lug extending outwardly from a side thereof. The riser assembly is pivotally mounted to the lug in a position where the first portion of the riser assembly joins the second portion of the riser assembly. The lug extends outwardly from a side of the boom opposite the link.

The gripper is fixedly mounted to the opposite end of the arm. In particular, the gripper is an assembly that includes a body lug having a surface affixed to the opposite end of the arm, a first gripper extending outwardly of the body on an opposite side of the arm, and a second gripper extending outwardly of the body on the side opposite the arm and in spaced relation to the first gripper. The first and second grippers are translatable along the body. The body has mounts thereon for selectively positioning the body in fixed relation to the arm. The arm can extend between transverse and 30° offset from transverse relative to the body.

An actuator is mounted at one end to the skid and an opposite end to the boom at a location offset from the pivotal mounting of the boom to the skid. This actuator serves to move the boom between the first and second positions. In the preferred embodiment, this actuator is a hydraulic cylinder that can be suitably operated so as to move the boom between the positions. In the present invention, the entire movement of the drilling pipe from the horizontal position to the vertical position is accomplished solely by the use of the actuator connected between the skid and the boom.

The present invention is also a method of moving a pipe from a horizontal orientation. This method comprises the steps of: 1) extending a boom over the horizontally oriented pipe such that grippers are positioned adjacent to the horizontally oriented pipe; 2) gripping the horizontally oriented pipe with the grippers, and 3) pivoting the boom upwardly such that the pipe is moved angularly through an interior of the boom until the pipe is in a vertical orientation. The arm is connected to an opposite end of a non-extensible link. This link is movable in relation to the boom. A brace is pivotally mounted at one end to the boom and at an opposite end to the arm. The angular movement of the pipe is solely caused by the connections of the boom with the arm, the link and the brace. The method of the present invention also includes vertically translating the grippers along the body such that the pipe moves vertically into a desired position. Specifically, this step involves stabbing an underlying pipe with an end of the pipe by the vertical translation of the pipe. The grippers can then be released from the pipe. An actuator is connected to the boom in a position above the bottom of the boom. The step of pivoting includes actuating the actuator so as to cause the boom to pivot upwardly from the horizontal orientation until the boom extends beyond a vertical orientation.

DETAILED DESCRIPTION OF THE INVENTION

Figure 1:
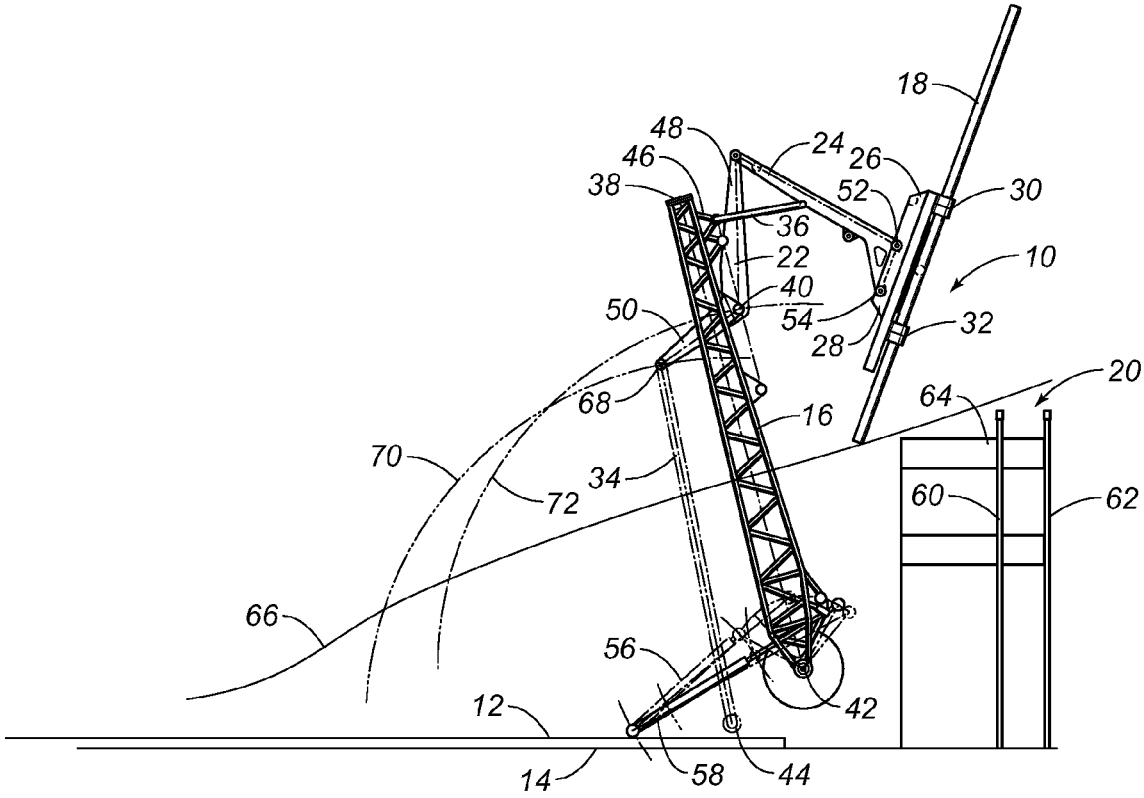
FIG. 1 is a side elevation view showing the pipe handling apparatus in accordance with the teachings of the preferred embodiment of the present invention.

Referring to FIG. 1, there is shown the pipe handling apparatus in accordance with the preferred embodiment of the present invention. The pipe handling apparatus is mounted on a skid 12 that is supported upon the bed 14 of a vehicle, such as a truck. The pipe handling apparatus in particular includes a boom 16 that is pivotally movable between a first position and a second position. In FIG. 1, an intermediate position of the pipe handling apparatus is particularly shown. In this position, the pipe 18 is illustrated in its position prior to installation on the drill rig 20. A riser assembly 22 is pivotally connected to the boom 16. An arm 24 is pivotally connected to an end of the riser assembly 22 opposite the boom 16. A gripper assembly 26 is fixedly connected to an opposite end of the arm 24 opposite the riser assembly 22. The gripper assembly 26 includes a body 28 and grippers 30 and 32. A link 34 has one end pivotally connected to the skid 12 and an opposite end pivotally connected to the end of the riser assembly 22 opposite the arm 24. A brace 36 is pivotally connected to the boom 16 and also pivotally connected to the arm 24 between the riser assembly 22 and the body 28 of gripper assembly 26.

In the present invention, the boom 16 is a structural framework of struts, cross members and beams. In particular, in the present invention, the boom 16 is configured so as to have an open interior such that the pipe 18 will be able to be lifted in a manner so as to pass through the interior of the boom 16. As such, the end 38 of the boom 16 should be strongly reinforced so as to provide the necessary structural integrity to the boom 16. A lug 40 extends outwardly from one side of the boom 16. This lug 40 is suitable for pivotable connection to the riser assembly 22. The boom 16 is pivotally connected at the opposite end 42 to a location on the skid 12. The pivotable connection at end 42 of the boom 16 is located in offset relationship and above the pivotable connection 44 of the link 34 with the skid 12. A small frame member 46 extends outwardly from the side of the boom 16 opposite the link 34. This frame assembly 46 has a pivotable connection with the brace 36.

The riser assembly 22 includes a first or outboard portion 48 and a second or inboard portion 50. The first or outboard portion 48 extends at an obtuse angle with respect to the second or inboard portion 50. The link 34 is pivotally connected to the end of the second portion 50 opposite the first or outboard portion 48. The arm 24 is pivotally connected to the end of the first or outboard portion 48 opposite the second or inboard portion 50. The lug 40 of the boom 16 is pivotally connected in an area generally between the first portion 48 and the second or inboard portion 50. This unique arrangement of the riser assembly 22 facilitates the ability of the present invention to carry out the movement of the pipe 18 between the horizontal orientation and the vertical orientation.

The arm 24 has an end pivotally connected to the end of the first or outboard portion 48 of the riser assembly 22. The opposite end of the arm 24 is connected to the gripper 26. In particular, a pair of pin connections engages a surface of the body 28 of the gripper assembly 26 so as to fixedly position the gripper assembly 26 with respect to the end of the arm 24. The pin connections 52 and 54 can be in the nature of bolts, or other fasteners, so as to strongly connect the body 28 of gripping means 26 with the arm 24. The bolts associated with pin connections 52 and 54 can be removed such that other gripper assemblies 26 can be affixed to the end of the arm 24. As such, the pipe handling apparatus 10 of the present invention can be adaptable to various sizes of pipe 18 and various heights of drilling rigs 20.

The gripper assembly 26 includes the body 28 with the grippers 30 and 32 translatable along the length of the body 28. This vertical translation of the grippers 30 and 32 allows the pipe 18 to be properly moved upwardly and downwardly once the vertical orientation of the pipe 18 is achieved. The grippers 30 and 32 are in the nature of conventional grippers which can open and close so as to engage the outer diameter of the pipe 18, as desired.

The link 34 is an elongate member that extends from the pivotable connection 44 to the pivotable connection 68 of the second portion or inboard 50 of the riser assembly 22. The link 34 is nonextensible and extends generally adjacent to the opposite side from the boom 16 from that of the arm 24. The link 34 will generally move relative to the movement of the boom 16. The brace 36 is pivotally connected to the small framework 46 associated with boom 16 and also pivotally connected at a location along the arm 26 between the ends thereof. Brace 36 provides structural support to the arm 24 and also facilitates the desired movement of the arm 24 during the movement of the pipe 18 between the horizontal orientation and the vertical orientation.

Actuators 56 and 58 are illustrated as having one end connected to the skid 12 and an opposite end connected to the boom 16 in a location above the end 42. When the actuators 56 and 58 are activated, they will pivot the boom 16 upwardly from the horizontal orientation ultimately to a position beyond vertical so as to cause the pipe 18 to achieve its vertical orientation. Within the concept of the present invention, a single hydraulic actuator can be utilized instead of the pair of hydraulic actuators 56 and 58, as illustrated in FIG. 1.

The drilling rig 20 is illustrated as having drill pipes 60 and 62 extending upwardly so as to have an end above the drill floor 64. When the pipe 18 is in its vertical orientation, the translatable movement of the grippers 30 and 32 can be utilized so as to cause the end of the pipe 18 to engage with the box of one of the drill pipes 60 and 62.

In FIG. 1, the general movement of the bottom end of the pipe 18 is illustrated by line 66. The movement of the pivot point 68 of the connection between the riser assembly 22 and the link 34 is illustrated by line 70. Curved line 72 illustrates the movement of the pivotable connection 40 between the boom 16 and the riser assembly 22.

In the present invention, the coordinated movement of each of the non-extensible members of the apparatus 10 is achieved with proper sizing and angular relationships. In essence, the present invention provides a four-bar link between the various components. As a result, the movement of the drill pipe 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators are only used for the pivoting of the boom. Since the skid 12 is located on the bed of a vehicle 14, the vehicle 14 can be maneuvered into place so as to properly align with the centerline of the drill pipe 60 and 62 of the drilling rig 20. Once the proper alignment is achieved by the vehicle 14, the apparatus 10 can be operated so as to effectively move the drill pipe to its desired position. The gripper assemblies of the present invention allow the drill pipe 18 to be moved upwardly and downwardly for the proper stabbing of the drill pipes 60 and 62. The present invention is adaptable to various lengths of pipe 18.

Various types of gripper assembly 26 can be installed on the end of the arm 24 so as to properly accommodate longer lengths of pipe 18. These variations are illustrated herein in connections FIGS. 6-9.

As such, instead of the complex control mechanisms that are required with prior art systems, the present invention achieves its results by simple maneuvering of the vehicle 14, along with operation of the hydraulic cylinders 56 and 58. All other linkages and movement of the pipe 18 are achieved purely because of the mechanical connections between the various components. As such, the present invention assures a precise, self-centering of the pipe 18 with respect to the desired connecting pipe. This is accomplished with only a single degree of freedom in the pipe handling system.

Figure 2:
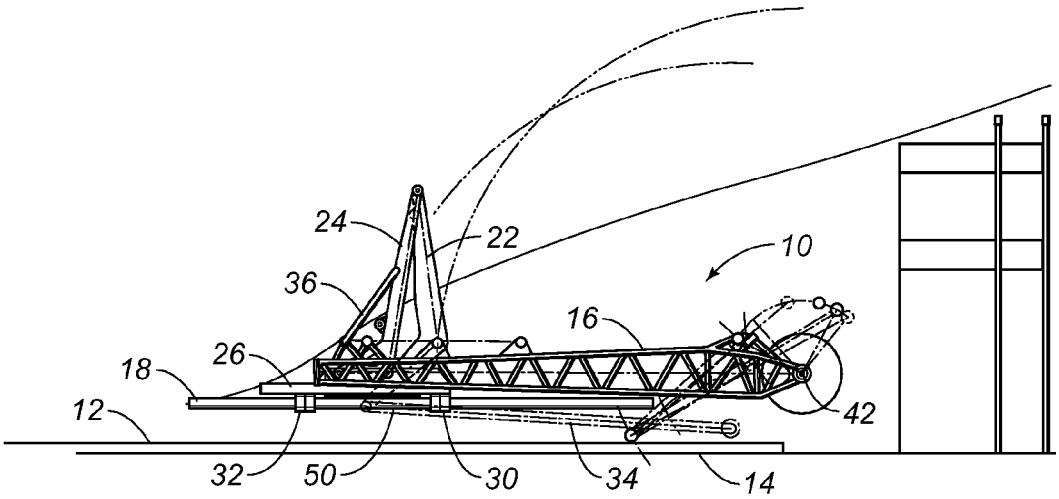
FIG. 2 is a side elevation view showing the pipe handling apparatus of the present invention in a first position.

FIG. 2 illustrates the drill pipe 18 in a generally horizontal orientation. In the present invention, it is important to note that the drill pipe can be delivered to the apparatus 10 in a position below the boom 16. In particular, the drill pipe can be loaded upon the skid 12 in a location generally adjacent to the grippers 30 and 32 associated with the gripper assembly 26. As such, the present invention facilitates the easy delivery of the drill pipe to the desired location. The grippers 30 and 32 will grip the outer diameter of the pipe 18 in this horizontal orientation.

In FIG. 2, it can be seen that the boom 16 resides above the drill pipe 18 and in generally parallel relationship to the top surface of the skid 12. The riser assembly 22 is suitably pivoted so that the arm 24 extends through the interior of the framework of the boom 16 and such that the gripper assembly 26 engages the pipe 18. The brace 36 resides in connection with the small framework of the boom 16 and also is pivotally connected to the arm 24. The link 34 will reside below the boom 16 generally adjacent to the upper surface of the skid 12 and is connected to the second portion or inboard 50 of the riser assembly 22 below the boom 16.

Figure 3:
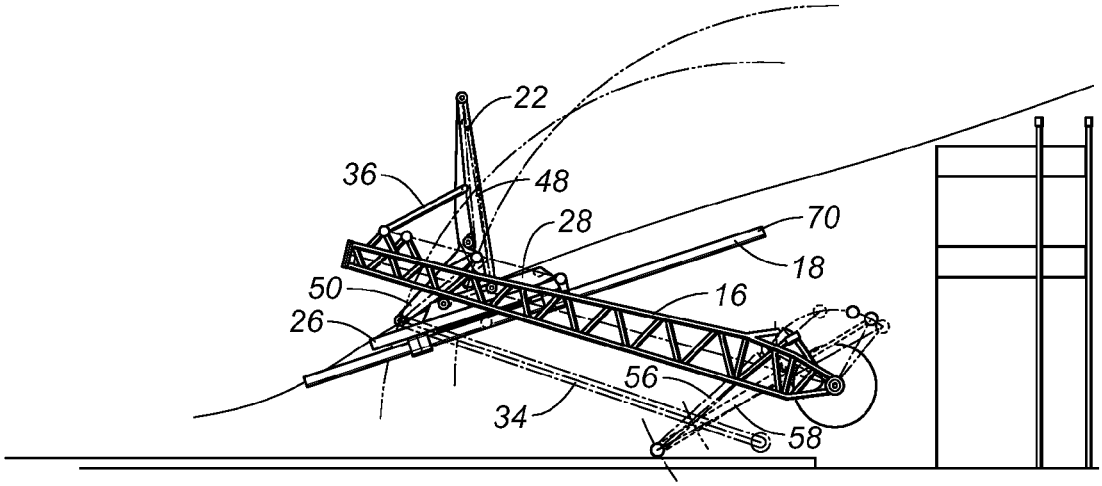
FIG. 3 is a side elevation view showing the pipe handling apparatus moving from the first position toward the second position.

FIG. 3 shows an intermediate position of the drill pipe 18 during the movement of the horizontal orientation to the vertical orientation. As can be seen, the gripper assembly 26 has engaged with the pipe 18. The riser assembly 22 is pivoting so that the end 70 of pipe 18 will pass through the interior of the framework of the boom 16. Also, the arm associated with the gripper assembly 26 serves to move the body 28 of the gripper assembly 26 through the interior of the framework of the boom 16. The brace 36 is pulling on the first or outboard portion 48 of riser assembly 22 so as to cause this motion to occur. The link 34 is pulling on the end of the second or inboard portion 50 of the riser assembly 22 so as to draw the first or outboard portion 48 upwardly and to cause the movement of the body 28 of the gripper assembly 26. The hydraulic actuators 56 and 58 have been operated so as to urge the boom 16 pivotally upwardly.

Figure 4:
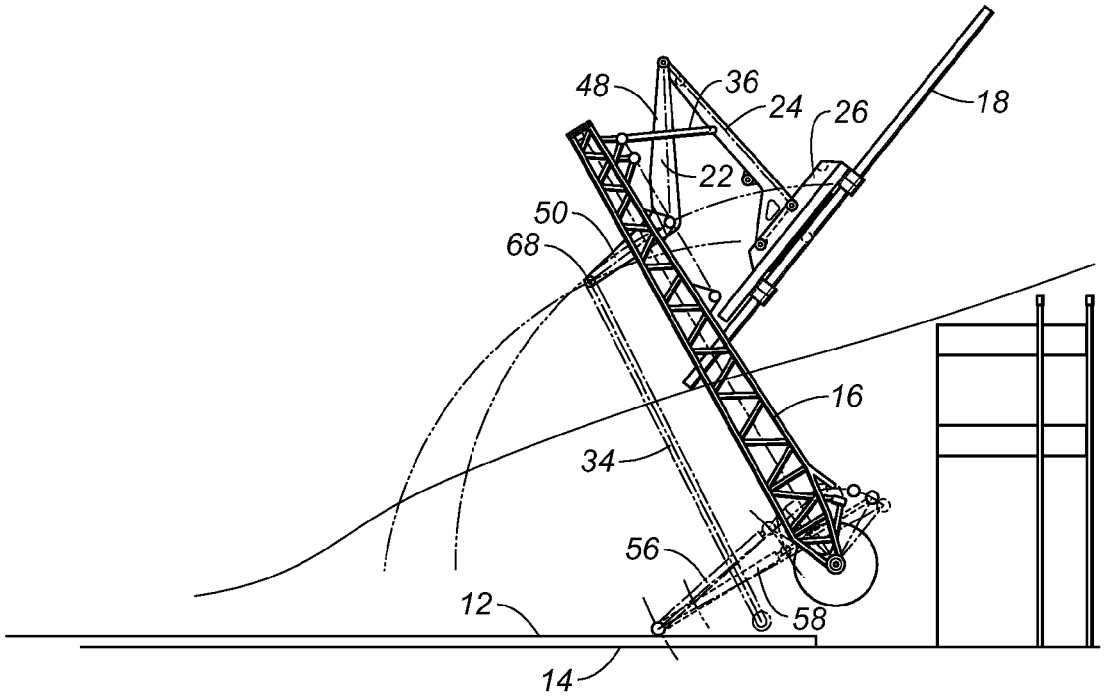
FIG. 4 is a side elevation view of the pipe handling apparatus showing the pipe handling apparatus as moving the pipe further to the second position.

FIG. 4 shows a further intermediate movement of the drill pipe 18. Once again, the hydraulic actuators 56 and 58 urge the boom 16 angularly upwardly away from the top surface of the skid 12. This causes the link 34 to have a pulling force on the pivotal connection 68 of the second or inboard portion 50 of the riser assembly 22. This causes the first or outboard portion 48 of the riser assembly 22 to move upwardly thereby causing the arm 24, in combination with the brace 36, to lift the gripper assembly 26 further upwardly and draw the pipe 18 completely through the interior of the boom 16. As can be seen, the relative size and relation of the various components of the present invention achieve the movement of the pipe 18 without the need for separate hydraulic actuators.

Figure 5:
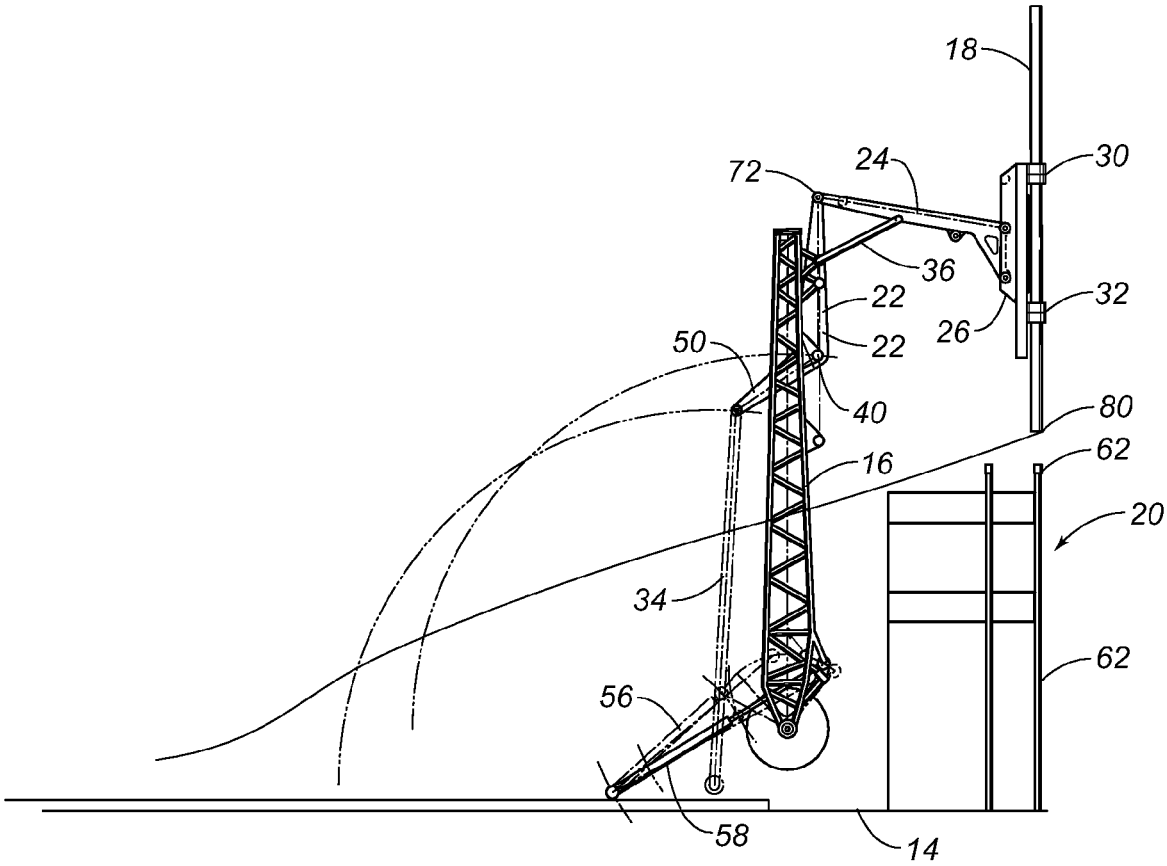
FIG. 5 is a side elevation view showing the pipe handling apparatus in its second position in which the pipe extends in a vertical orientation.

FIG. 5 illustrates the drill pipe 18 in its vertical orientation. As can be seen, the drill pipe 18 is positioned directly above the underlying pipe 62 on the drilling rig 20. The further upward pivotal movement of the boom 16 is caused by the hydraulic cylinders 56 and 58. This causes the link 34 to rotate and draw the end of the second or inboard portion 50 of the riser assembly 22 downwardly. The riser assembly 22 rotates about the pivot point 40 such that the first or outboard portion 48 of the riser assembly 22 has a pivot 72 at its upper end. The brace 36 is now rotated in a position so as to provide support for the arm 24 in this upper position. The gripper assembly 26 has the grippers 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the present invention and without the need for complex control mechanisms and hydraulics.

In order to install the drill pipe 18 upon the pipe 62, it is only necessary to vertically translate the grippers 30 and 32 within the body 28 of the gripper assembly 26. As such, the end 80 can be stabbed into the box connection 82 of pipe 62. Suitable tongs, spinner, or other mechanisms can be utilized so as to rotate the pipe 18 in order to achieve a desired connection. The grippers 30 and 32 can then be released from the exterior of the pipe 18 and returned back to the original position such that another length of drill pipe can be installed.

Figure 6:
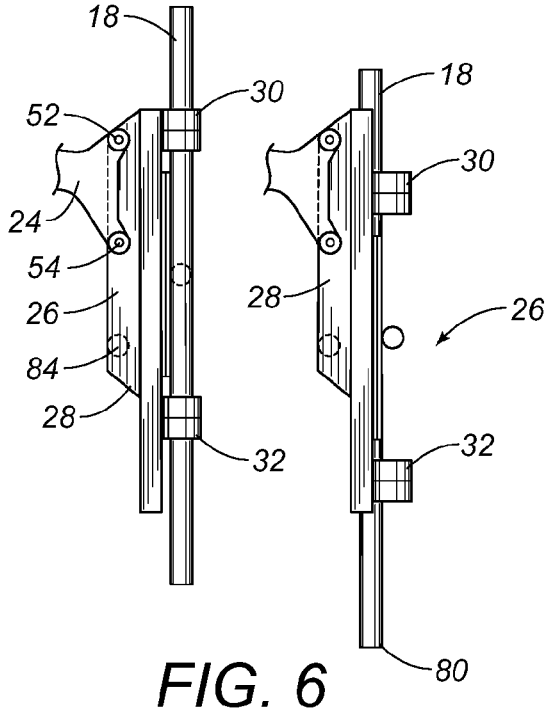
FIG. 6 is an illustration of the gripper assembly as vertically translating the pipe.

FIG. 6 is a detailed view of the gripper assembly 26 of the present invention. In FIG. 6, the pin connections 52 and 54 have been installed into alternative holes formed on the body 28 of the gripper assembly 26. The holes, such as hole 84, can be formed in a surface of the body 28 so as to allow selective connection between the end of the arm 24 and the body 28 of gripper assembly 26. As such, the position of the gripper assembly 26 in relation to the arm 24 can be adapted to various circumstances.

It can be seen that the pipe 18 is engaged by grippers 30 and 32 of the gripper assembly 26. The configuration of the grippers 30 and 32, as shown in FIG. 6, is particularly designed for a short length (approximately 30 feet) of drill pipe. In FIG. 6, it can be seen that the grippers 30 and 32 are translated relative to the body 28 so as to lower end 80 of pipe 18 downwardly for connection to an underlying pipe.

Figure 7:
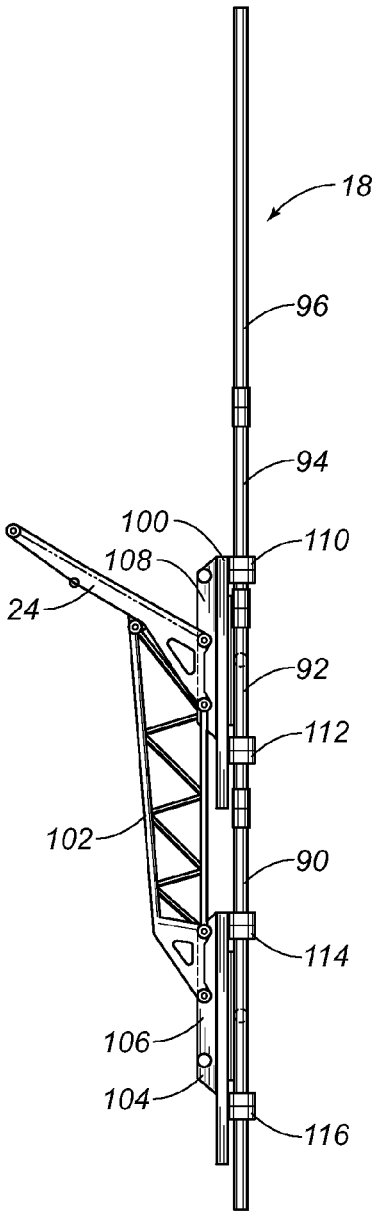
FIG. 7 is a side elevation view of a first alternative embodiment of the gripper assembly of the present invention.

Occasionally, it is necessary to accommodate longer lengths of pipes. In other circumstances, it is desirable to accommodate pipes that are already assembled in an extended length. In FIG. 7, it can be seen that the drill pipe 18 is formed of separate sections 90, 92, 94 and 96 that are joined in end-to-end connection so as to form an extended length of the pipe 18. When such pipe arrangements are required, the gripper assembly 26 of the present invention will have to be adapted so as to accommodate such extended lengths. Fortunately, the structure of the apparatus 10 of the present invention can accommodate such an arrangement. As can be seen in FIG. 7, the arm 24 is connected to a first gripper assembly 100 and connected by framework 102 to a second gripper assembly 104. The second gripper assembly 104 is located directly below and vertically aligned with the first gripper assembly 100. The framework 102 includes a suitable pin connection for engaging the body 106 of the second gripper assembly 104. The first gripper assembly 100 has body 108 that is directly connected to the pin connections associated with the arm 24. The gripping assembly 100 includes grippers 110 and 112 which engage in intermediate position along the length of pipe 18. The grippers 114 and 116 of the second gripper assembly 104 engage the lower portion of the pipe 18. The method of moving the pipe 18 from the horizontal position to the vertical position is similar to that described hereinbefore.

It should be noted that the arm 24 can extend at various angles with respect to the gripper assembly. In the preferred embodiment, the arm 24 will be generally transverse to the length of the body associated with the gripper assemblies. However, if needed to accommodate certain drilling rig height and arrangements, the arm 24 can be angled up to 30° from transverse with respect to the body associated with the gripper assembly.

Figure 8:
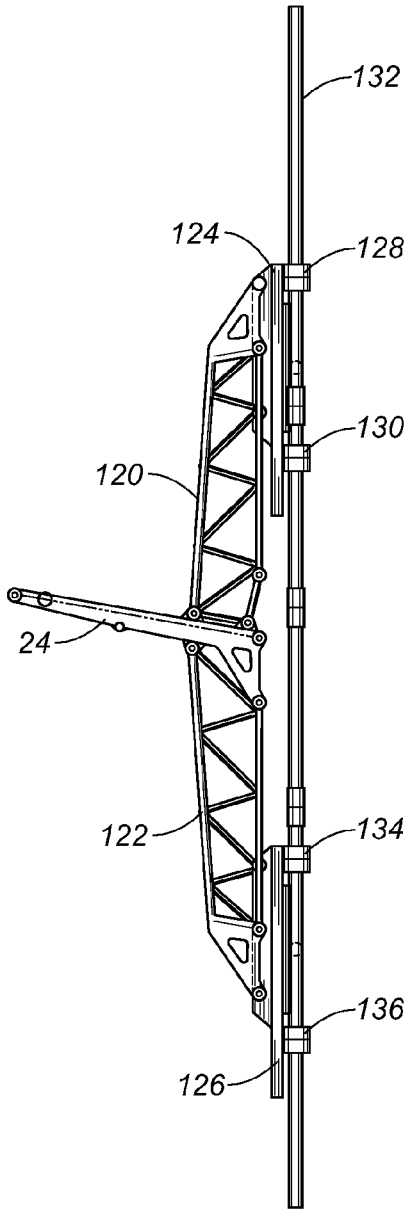
FIG. 8 is a side elevation view showing a second alternative embodiment of the gripper assembly of the present invention.

In FIG. 8, it can be seen that the arm 24 has a first framework 120 extending upwardly from the top of the arm 24 and a second framework 122 extending below the arm 24. The framework 120 includes a gripper assembly 124 affixed thereto. The framework 122 includes a gripper assembly 126 connected thereto. The arm 24 will include suitable pin connections located on the top surface thereof and on the bottom surface thereof so as to engage with the frameworks 120 and 122. The gripper assembly 124 has suitable grippers 128 and 130 for engaging an upper portion of the pipe 132. The gripper assembly 126 includes grippers 134 and 136 for engaging with a lower portion of the pipe 132. As illustrated in FIG. 8, the pipe 132 is a multiple section pipe. However, pipe 132 can be an extended length of a single pipe section.

Figure 9:
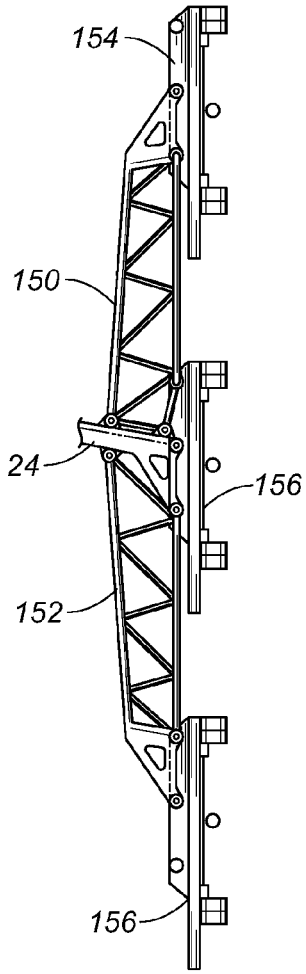
FIG. 9 is a side elevation view showing a third alternative embodiment of the gripper assembly of the present invention.

FIG. 9 shows still another embodiment of the gripper assembly structure of the present invention. In FIG. 9, the arm 24 is connected to the upper framework 150 and to the lower framework 152. Gripping assemblies 154, 156 and 158 are provided. The gripper assembly 154 is connected to an upper end of the upper framework 150. The gripper assembly 158 is connected to a lower end of the lower framework 152. The gripper assembly 156 is intermediately located directly on the opposite side of the end of the arm 24 and connected to the lower end of the upper framework 150 and to the upper end of the lower framework 152. As such, the present invention provides up to three gripper assemblies to be connected. This can be utilized so as to accommodate even longer lengths of pipe, if needed.

The present invention achieves a number of advantages over the prior art. Most importantly, the present invention provides a pipe handling apparatus and method that minimizes the number of control mechanisms, sensors and hydraulic systems associated with the pipe handling system. Since the movement of the pipe is achieved in a purely mechanical way, only a single hydraulic actuator is necessary for the movement of the boom. All of the other movements are achieved by the interrelationship of the various components. As such, the present invention achieves freedom from the errors and deviations that can occur through the use of multiple hydraulic systems. The simplicity of the present invention facilitates the ability of a relatively unskilled worker to operate the pipe handling system. The amount of calibration is relatively minimal. Since the skid 12 associated with the present invention can be transported by a truck, various fine movements and location of the pipe handling apparatus can be achieved through the simple movement of the vehicle. The pipe handling apparatus of the present invention is independent of the drilling rig. As such, a single pipe handling apparatus that is built in accordance with the teachings of the present invention can be utilized on a number of rigs and can be utilized at any time when required. There is no need to modify the drilling rig, in any way, to accommodate the pipe handling apparatus of the present invention. Since the pipes are loaded beneath the boom, the providing of the pipe to the pipe handling apparatus can be achieved in a very simple manner. There is no need to lift the pipes to a particular elevation or orientation in order to initiate the pipe handling system.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

The invention claimed is:

1. A pipe handling apparatus comprising:

a boom pivotally movable between a first position and a second position;

a riser assembly having a first portion extending outwardly at an obtuse angle with respect to a second portion, the riser assembly pivotally connected to the boom between the first portion and the second portion;

an arm pivotally connected at an end of the first portion of the riser assembly and extending outwardly therefrom;

a gripper assembly affixed to an opposite end of the arm, the gripper assembly for gripping a diameter of a pipe;

a link pivotally connected to the second portion of the riser assembly, the link pivotable at an end of the second portion opposite of the first portion so as to move relative to the movement of the boom between the first and second positions; and a brace having one end pivotally connected to the boom and an opposite end pivotally connected to the arm between the ends of the arm.

2. The pipe handling apparatus of claim 1, the first position of the boom being generally horizontal, the gripper assembly having a vertical orientation when the boom is in the second position.

3. The pipe handling apparatus of claim 1, further comprising:

a skid extending in a horizontal orientation and positioned below the boom, the boom being pivotally mounted upon the skid.

4. The pipe handling apparatus of claim 3, further comprising:

a vehicle having a bed receiving the skid thereon.

5. The pipe handling apparatus of claim 3, the end of the link opposite the second portion of the riser assembly being pivotally mounted upon-the skid in a position offset from and below the pivotal mounting of the boom on the skid.

6. The pipe handling apparatus of claim 3, further comprising:

a pipe extending in a horizontal orientation upon the skid, the gripper assembly facing the pipe when the boom is in the first position, the gripper assembly positioned below the boom when the boom is in the first position.

7. The pipe handling apparatus of claim 1, the boom having a lug extending outwardly from a side thereof, the riser assembly pivotally mounted to the lug in a position where the first portion joins the second position.

8. The pipe handling apparatus of claim 7, the lug extending outwardly from a side of the boom opposite the link.

9. The pipe handling apparatus of claim 1, each of the brace and the link being non-extensible.

10. The pipe handling apparatus of claim 1, the gripper assembly fixedly mounted to the opposite end of the arm.

11. The pipe handling apparatus of claim 1, the gripper assembly comprising:

a body having a surface affixed to the opposite end of the arm;

a first gripper extending outwardly of the body on a side opposite the arm; and a second gripper extending outwardly of the body and the side opposite the arm in spaced relation to the first gripper.

12. The pipe handling apparatus of claim 11, the first and second grippers being translatable along the body.

13. The pipe handling apparatus of claim 11, the body having a mounting assembly thereon for selectively positioning the body in fixed relation to the arm.

14. The pipe handling apparatus of claim 11, the arm extending between transverse and 30° offset from transverse relative to the body.

15. The pipe handling apparatus of claim 3, further comprising:

an actuating assembly mounted at one end of the skid at an opposite end to the boom at a location offset from the pivotal mounting of the boom to the skid, the actuating assembly for moving the boom between the first and second positions.

* * * * *